US010378275B2

(12) United States Patent
Ahdoot

(10) Patent No.: US 10,378,275 B2
(45) Date of Patent: Aug. 13, 2019

(54) SUNLIGHT-REFLECTING BLINDS

(71) Applicant: Eliot Ahdoot, Dollard-des-Ormeaux (CA)

(72) Inventor: Eliot Ahdoot, Dollard-des-Ormeaux (CA)

( * ) Notice: Subject to any disclaimer, the term of this patent is extended or adjusted under 35 U.S.C. 154(b) by 111 days.

(21) Appl. No.: 15/148,751

(22) Filed: May 6, 2016

(65) Prior Publication Data

US 2016/0326798 A1 Nov. 10, 2016

Related U.S. Application Data

(60) Provisional application No. 62/157,912, filed on May 6, 2015.

(51) Int. Cl.

| | |
|---|---|
| ***E06B 9/30*** | (2006.01) |
| ***E06B 9/386*** | (2006.01) |
| ***E06B 9/32*** | (2006.01) |
| *E06B 9/24* | (2006.01) |

(52) U.S. Cl.

CPC ..... *E06B 9/386* (2013.01); *E06B 9/30* (2013.01); *E06B 9/32* (2013.01); *E06B 2009/2417* (2013.01); *E06B 2009/2494* (2013.01)

(58) Field of Classification Search

CPC ... E06B 9/386; E06B 9/30; E06B 9/28; E06B 2009/2417; E06B 2009/2494; E06B 9/26; E06B 9/303

See application file for complete search history.

(56) References Cited

U.S. PATENT DOCUMENTS

| | | | | |
|---|---|---|---|---|
| 2,103,788 A * | 12/1937 | Mohrfeld | ..... | E06B 9/386 160/236 |
| 2,146,816 A * | 2/1939 | Grassby, Jr. | ..... | E06B 9/386 160/178.1 R |
| 2,315,605 A * | 4/1943 | Ehrenfeld | ..... | E06B 9/303 160/114 |
| 2,633,191 A * | 3/1953 | Curtis, Jr. | ..... | E06B 9/386 160/176.1 R |

(Continued)

FOREIGN PATENT DOCUMENTS

| | | |
|---|---|---|
| CN | 2777168 | 3/2005 |
| CN | 201991424 | 9/2011 |

(Continued)

*Primary Examiner* — Katherine W Mitchell
*Assistant Examiner* — Jeremy C Ramsey
(74) *Attorney, Agent, or Firm* — Benoit & Cote, Inc.; C. Marc Benoit

(57) ABSTRACT

There is described a blind for installation between an inner environment and an outer environment where light originates. The blind comprises slats substantially forming a vertically periodic arrangement. Each one of the slats extends in a substantially horizontal axis, and comprises an upper surface and a lower surface. The upper surface has a normal oriented both upwardly and toward the outer environment, and comprises a coating providing specular reflection. The lower surface has reflection normal oriented both downwardly and toward any one of the outer environment and the inner environment, and comprises a coating providing specular reflection. The upper surface and the lower surface of a given slat are joined at an apex pointing toward the outer environment.

18 Claims, 15 Drawing Sheets

(56) References Cited

U.S. PATENT DOCUMENTS

| | | | | |
|---|---|---|---|---|
| 3,008,196 | A * | 11/1961 | Springer | E06B 3/6715 160/327 |
| 3,471,221 | A * | 10/1969 | Seeger | E06B 7/084 359/596 |
| 4,292,763 | A * | 10/1981 | Barnes | E06B 9/28 160/236 |
| 4,917,168 | A * | 4/1990 | Chen | E06B 9/307 160/176.1 R |
| 6,006,812 | A * | 12/1999 | Corey | E06B 9/262 160/176.1 R |
| 6,845,805 | B1 * | 1/2005 | Koster | E06B 9/386 160/236 |
| 8,723,466 | B2 | 5/2014 | Chambers et al. | |
| 2003/0112518 | A1 * | 6/2003 | Rogers | E06B 9/28 359/596 |
| 2010/0101565 | A1 * | 4/2010 | Maxson | E04F 10/08 126/702 |
| 2011/0192551 | A1 | 8/2011 | Rance | |
| 2012/0120496 | A1 * | 5/2012 | Thuot | E06B 7/082 359/596 |
| 2012/0205055 | A1 * | 8/2012 | Underwood | E06B 9/386 160/166.1 |

FOREIGN PATENT DOCUMENTS

| | | |
|---|---|---|
| CN | 103388446 | 11/2013 |
| CN | 203334925 | 11/2013 |
| DE | 19823758 | 12/1999 |
| JP | 5267034 | 10/1993 |
| JP | 5319430 | 12/1993 |
| JP | 3281330 | 1/2001 |
| JP | 2001032651 | 2/2001 |
| JP | 2002220981 | 8/2002 |
| JP | 2005226278 | 8/2005 |
| JP | 2005240469 | 9/2005 |
| JP | 2010160500 | 7/2010 |
| JP | 2011074705 | 4/2011 |
| KR | 200302950 | 2/2003 |
| KR | 1020130012690 | 2/2013 |
| KR | 101257291 | 5/2013 |
| WO | WO/2011/064765 | 6/2011 |
| WO | WO/2013/177655 | 12/2013 |

* cited by examiner

SUNLIGHT-REFLECTING BLINDS

CROSS-REFERENCE TO RELATED APPLICATIONS

This application claims priority from U.S. provisional patent application No. 62/157,912 filed on May 6, 2015.

BACKGROUND (a) Field

The subject matter disclosed generally relates to blinds. More specifically, it relates to blinds which selectively reflect sunlight.

(b) Related Prior Art

Heating and air conditioning of buildings are a major issue in energetic resource management. Together, they amount to a significant fraction of the maintenance cost of building. When buildings are large, the cost of maintaining a comfortable temperature is important, and the impact on environmental resource consumption can be significant. Insulation is of course a primary factor, but the configuration of windows plays a role in the thermal energy balance of the building, since this is where the sunlight penetrates into the building to heat it from inside.

Many technologies were developed to address this issue, with mixed results. Some technologies involve placing a reflector either inside or outside the window. It has the disadvantage of blocking sunlight even during winter times, when sunlight is desired inside the building. Placing a blocking structure (blinds, panels) close to the window inside the building has the disadvantage of absorbing sunlight during summer times, producing heat within the building. If blinds are installed outside, they are vulnerable to weather events.

More recent technologies involving architectural solutions, such as horizontal structures above windows to hide sunlight when the sun has a high inclination, provide a suitable solution for new buildings. However, this solution is more costly and is better suited for new buildings.

Some technologies which address this issue have been developed. For example, document JP2005240469A illustrates a window with a glass shaped as to reflect sunlight if the incoming sunlight has a high inclination, and to let the sunlight pass through the window if the inclination is low. This technology is however costly, sophisticated and fragile, since it involves shaping glass. Furthermore, it cannot be removed by a user.

Document DE19823758A1 shows a blind comprising reflectors with multiple surfaces with incremental inclination thereon to provide the same effect. However, the shape is complicated to manufacture and therefore expensive. Furthermore, the user can modify the general inclination of the blinds to have them more or less effective, which can lead to sub-optimal configurations for long periods of time.

There is therefore a need for a structure, such as a blind, that would reflect sunlight away when its inclination is high (summer) and let the sunlight pass through when its inclination is low (winter), the blind having a simple shape which is easy and inexpensive to produce, that can replace standard blinds in houses, offices and other buildings.

SUMMARY

According to an embodiment, there is provided a blind for installation between an inner environment and an outer environment where light originates, the blind comprising:

slats substantially forming a vertically periodic arrangement, each one of the slats extending in a substantially horizontal axis and comprising:

an upper surface having a normal oriented both upwardly and toward the outer environment, the upper surface having a coating that provides specular reflection, and a lower surface having a normal oriented both downwardly and toward any one of the outer environment and the inner environment, the lower surface having a coating that provides specular reflection, the upper surface having a lower edge, wherein the upper surface and the lower surface of a given slat are joined at an apex near the lower edge of the upper surface.

According to an aspect, the blind further comprises strings to hold the slats in the vertically periodic arrangement.

According to an aspect, the blind further comprises a lifting mechanism for pulling the strings and thereby lifting at least some of the slats.

According to an aspect, the blind further comprises an angle holding cradle for maintaining an offset between different ones of the strings and thereby maintaining a constant angle of the upper surface even though at least some of the slats are lifted.

According to an aspect, the lower surface has a normal oriented both downwardly and toward the outer environment.

According to an aspect, the light has an inclination with respect to the horizontal, further wherein:

when inclination of the light is above a high inclination threshold, the light is substantially totally outwardly reflected by the upper surface of the slats;

when inclination of the light is below a low inclination threshold, the light partially penetrates directly in the inner environment and the remaining portion of the light is reflected outwardly by both the upper and lower surfaces; and when inclination of the light is between the high inclination threshold and the low inclination threshold, the light partially penetrates directly into the inner environment, and is partially outwardly reflected by a double reflection on both the upper surface and the inner surface.

According to an aspect, the lower surface has a normal oriented both downwardly and toward the inner environment.

According to an aspect, the lower surface and the upper surface have normals oriented in substantially opposite directions.

According to an aspect, the upper surface and the lower surface are integrally connected along their whole surface.

According to an aspect, the blind further comprises an angle holding cradle for maintaining a constant angle of the upper surface, wherein the constant angle, together with a period of the periodic arrangement, defines high and low inclination thresholds, wherein the light has an inclination with respect to the horizontal and, further wherein the constant angle is set such that:

when inclination of the light is above the high inclination threshold, the light is substantially totally outwardly reflected by the upper surface of the slats;

when inclination of the light is below the low inclination threshold, the light partially penetrates directly in the inner environment and the remaining portion of the light is reflected outwardly by the upper surface; and when inclination of the light is between the high inclination threshold and the low inclination threshold, the light partially penetrates directly into the inner environment, and is partially inwardly reflected by a double reflection on both the upper surface and the inner surface.

According to an embodiment, there is provided a blind for installation close to an interface between an inner environment and an outer environment where light originates, the light having an inclination with respect to the horizontal, the blind comprising:

slats forming a vertically periodic arrangement, each one of the slats extending in a substantially horizontal axis and comprising an upper surface and a lower surface, an angle holding cradle for maintaining a constant angle of the upper surface, wherein the constant angle, together with a period of the periodic arrangement, defines high and low inclination thresholds, wherein the constant angle is set such that:

when inclination of the light is above the high inclination threshold, the light is substantially totally outwardly reflected by the upper surface of the slats;

when inclination of the light is below the low inclination threshold, the light partially penetrates directly in the inner environment and the remaining portion of the light is inwardly reflected by at least the first one of: the upper surface and the lower surface; and when inclination of the light is between the high inclination threshold and the low inclination threshold, the light partially penetrates directly into the inner environment, and is partially reflected by a double reflection on both the upper surface and the inner surface.

According to an aspect, the upper surface has a coating providing specular reflection.

According to an aspect, the lower surface has a coating providing specular reflection.

According to an aspect, the coating of the upper surface is oriented both upwardly and toward the outer environment.

According to an aspect, the lower surface has a normal oriented both downwardly and toward the outer environment.

According to an aspect, when inclination of the light is below a low inclination threshold, the light is reflected outwardly by both the upper and lower surfaces; and when inclination of the light is between the high inclination threshold and the low inclination threshold, the light is partially outwardly reflected by a double reflection on both the upper surface and the inner surface.

According to an aspect, the coating of the lower surface is oriented both downwardly and toward the inner environment.

According to an aspect, the lower surface and the upper surface have normals oriented in substantially opposite directions.

According to an aspect, the upper surface and the lower surface are integrally connected along their whole surface.

According to an aspect, when inclination of the light is below a low inclination threshold, the light is reflected outwardly by the upper surface only; and when inclination of the light is between the high inclination threshold and the low inclination threshold, the light is partially inwardly reflected by a double reflection on both the upper surface and the inner surface.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

There are disclosed embodiments of a window blind for reflecting sunlight outwardly when the sunlight inclination is high and for letting a greater fraction of the sunlight in, either by direct penetration or by inward reflection on the blind, when the sunlight inclination is low.

Figure 1:
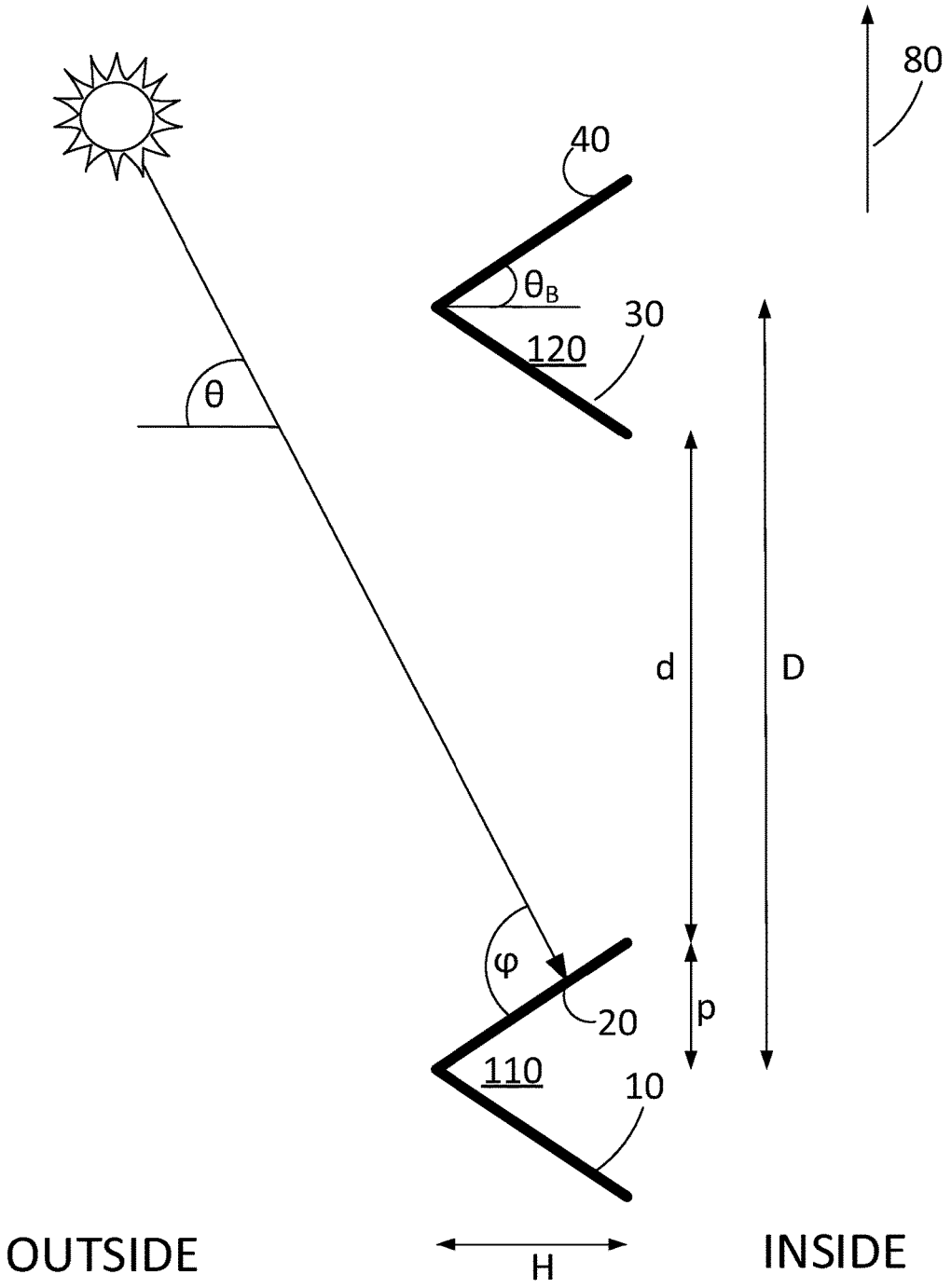
FIG. 1 is a side view illustrating a pair of slats of the blind, including various angles used to describe the system, according to an embodiment.

Referring now to the drawings, and more particularly to FIG. 1, a side view illustrates a blind 50 comprising a plurality of slats 100. The slats 100 extend (at least approximately) along a horizontal axis. There is shown only a pair of slats (110, 120) in FIG. 1 and FIGS. 3-9 to better illustrate the workings of the blind 50 (i.e., to show how sunlight react on a slat and between a pair of them).

The first (or lower) slat 110 comprises a lower surface 10 and an upper surface 20. The second (or upper) slat 120 comprises a lower surface 30 and an upper surface 40.

Figure 2:
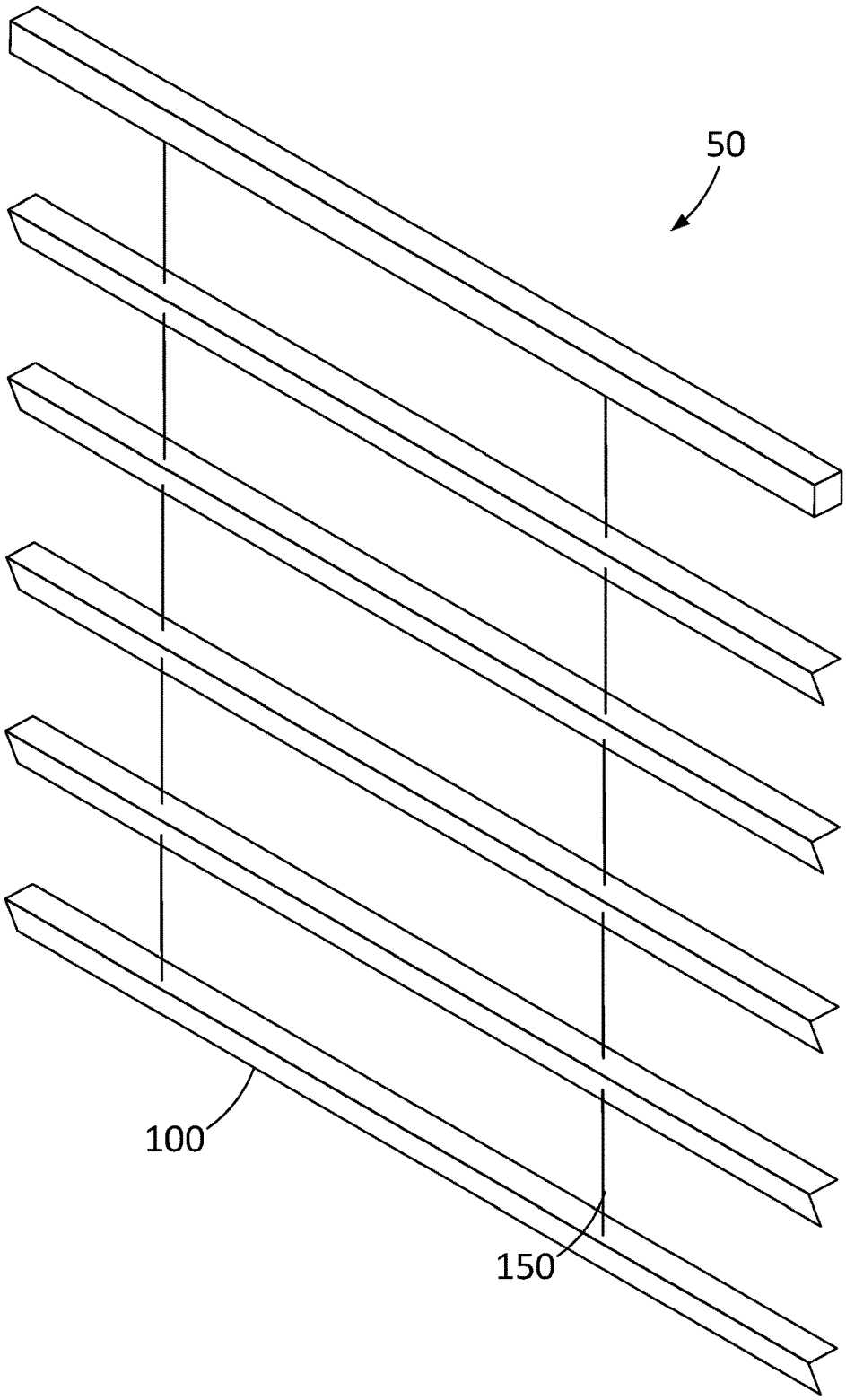
FIG. 2 is a perspective view of a sunlight-reflecting blind, according to an embodiment.

A complete blind 50 usually comprises a greater number of slats 100, as shown in FIG. 2. The plurality of slats 100 are usually separated by a regular distance D (the distance between slats 100 being empty). This vertical arrangement thereby forms a periodic pattern of spatial period D. However, the distance between adjacent slats 100 can be irregular (this is not shown, and the geometrical considerations of such a system are not formally analyzed herein).

The slats 100 are installed on strings 150, or any other attachment means between slats 100 as known in the art of window blinds. Small holes can be pierced in specific parts of the slats 100 to have the strings 150 pass therethrough. A connector, or any other way to attach the string 150 to the slat 100, needs to be provided to hang the slats 100 at specific locations on the strings 150 so that they do not all fall downwardly. A system for lifting the slats 100 up and letting them go down can be provided. Such lifting systems do not need to be described herein as they are already known in the art of window blinds.

Now referring back to the slats 110 and 120 shown in FIG. 1, the upper surface 20 and lower surface 10 are reflective surfaces. More specifically, they reflect a high percentage of the incoming light (i.e., sunlight). Preferably, they are reflective as to enable specular reflection. Metallic coatings, such as aluminum, or mirror-like coatings enable specular reflection. Surfaces are usually substantially flat.

As shown in FIG. 1, the upper surfaces (20, 40) define an upper surface inclination with the horizon, $\theta_{B1}$. The lower surfaces (10, 30) define a lower surface inclination with the horizon, $\theta_{B2}$ (this angle may be defined with respect to the horizon, as shown in FIG. 1, so $\theta_{B2}$ is usually negative). Although the upper and lower surface inclinations can be different one from the other, they are shown as substantially equal and will be considered as equal ($\theta_{B1}=-\theta_{B2}=\theta_B$) in the geometrical analysis detailed further below, causing symmetry of the slat with respect to the horizon. In this case, this angle can be defined as $\theta_B$. Similarly, for different slats (110, 120), this angle can be different, although they will be considered as equal for the purpose of the analysis. Having different values of $\theta_B$ for different slats does not substantially affect the overall workings of the blind 50, although it may affect negatively its optimal performance for reflecting or letting sunlight in the right circumstances. However, having $\theta_{B1}$ different than $\theta_{B2}$ may not affect performance; it only complicates the geometrical modeling of the blind 50.

There is further provided some holding means 200 for holding the upper surfaces (20, 40) and lower surfaces (10, 30) in the angle at which they are supposed to be. Example of holding means are: a connector (small physical piece) linking the bottom of the upper surface 20 and the top of the lower surface 10, a configuration of the strings 150 which keep the surfaces in the right inclination, a back wall extending from the lower surface (10, 30) to the upper surface (20, 40) which gives a triangular cross-section to the slat (110, 120), etc. According to another embodiment, the slat is a single piece of solid material that is manufactured with a bend, thereby forming the upper and the lower surfaces. In this case, there is no need for holding means 200, since the natural joint between the upper and lower surfaces is solid enough to maintain the shape and integrity of the slat 100. This joint forms an apex that points toward the outside environment.

As shown in FIG. 1, the upper surfaces (20, 40) are directed upwardly and outwardly (i.e., toward the outer environment). The lower surfaces (10, 30) are directed downwardly and outwardly (i.e., toward the outer environment). Another embodiment, described further below, comprises lower surfaces (10, 30) which are rather directed downwardly and inwardly (i.e., toward the inner environment). The direction of a surface refers to the normal of the reflecting surface.

Still referring to FIG. 1, although the period of the slat 100 is defined as D, the slats 100 actually occupy a height so that the empty distance between adjacent slats is defined as d, as shown. The height occupied may be defined as 2p, where p is the projection of either the upper surface (20, 40) or lower surface (10, 30) on a vertical axis 80. If the length of one of those surfaces as seen on the side view of FIG. 1 is defined as S, then $p=S\cdot\sin(\theta_B)$. As a reminder, it is considered that $\theta_{B1}=\theta_{B2}=\theta_B$ for those geometrical considerations, and that the upper and lower surfaces have the same length S, although it may not be true in a real embodiment. It implies that $D=d+2p$.

The vertical axis 80 is shown as extending vertically at the extremal ends of the surfaces of the slats 100. The surfaces extend away from this vertical axis 80 to a distance defined as $H=S\cdot\cos(\theta_B)$. One can also deduce other relations, such as $\theta_B=\arctan(p/H)$ and $S^2=p^2+H^2$.

For the purpose of geometrical modeling, one can see that a mathematically ideal blind (which has a regular period, and identical and symmetrical slats) is totally defined with only three variables: D, d, and $\theta_B$. All other values can be computed therefrom.

As a reminder, the purpose of the blind 50 is to have an improved management of the sunlight that comes in a building, room, etc., which can be defined as an inner environment. The sunlight, or any other significantly powerful light, originates from an outer environment. The blind 50 is preferably located at an interface between the inner and outer environments to selectively reflect incoming light and prevent it to be transmitted and absorbed in the inner environment where the temperature would undesirably increase.

Locating the blind 50 by a window as for conventional blinds is usually expected, although a substantial distance with the window could exist for some reason. The blind 50 is usually installed inside for practical reasons; however installing it outside is also possible if weather conditions are not too harsh and if aesthetics is not an issue. However, keeping the surfaces clean (to maintain specular reflection) is much easier if the blind 50 is kept in a clean and controlled environment. The blind 50 may also be used for inner environments which are open (do not have windows but rather open spaces making the transition with inside, such as patios, open doors, open garage doors, open windows, halls, etc.). The blind 50 can be installed close to these transitional spaces.

The inclination of the sunlight, $\theta$, is defined with respect to the horizon. The angle of incidence with any surface of the slat 100 (usually the lower surface 10 although the upper surface 20 may also be involved in specific cases as explained below) is defined as $\varphi$, as seen in FIG. 1. It means that $\varphi=\theta+\theta_B$.

The sunlight can be modeled as a point source, but the fact that it is an extended source makes the real system actually slightly less optimal that in a mathematical formalization.

For the blind 50 to be efficient in performing its purpose, it should reflect sunlight outwardly (away from the inner environment, i.e., back to the outer environment) when the temperature is expected to be (too) high in the inner environment. Usually, it implies reflecting sunlight when the sunlight has a high inclination, such as in the middle of a summer day.

It should also let sunlight in the inner environment when the temperature is expected to be (too) low therein. It should let sunlight in when the sun inclination is low, for example in winter times, especially in the morning when the inner environment needs to be warmed after the night.

Therefore, the blind 50 needs to selectively reflect light based upon its inclination, preferably without any user assistance. For instance, the angles of the slats 100 should not be modifiable by the user so that they remain optimal for their task.

It will be apparent that the optimal angles ($\theta_B$) and distances (D, d) of the slats 100 depend on latitude (which has a high impact on the sunlight inclination throughout the year and on its daily variations) and on climate (heating and air conditioning needs are not the same everywhere, even for a given latitude).

The blind 50 described above including slats (110, 120) having reflective surfaces allow this selective reflection of sunlight.

More precisely, seven situations can occur with varying degrees of importance, as shown in FIGS. 3-9 and described below. In these situations, which depend on the actual inclination of the sun and on the blind geometry (D, d, $\theta_B$), the sunlight is reflected in substantially different proportions.

The first situation is characterized by a simple outward reflection of the incoming sunlight on the upper surface 20 for the whole incoming sunlight. (The term "simple" is intended to mean that the light reflects only once on a surface before going back to the outside; it does not undergo double or multiple reflection.) This situation is desired when the inner environment is already warm and not more sunlight is wanted therein. This need usually arises when the sunlight has a high inclination. Fortunately, the first situation occurs under these circumstances, i.e., total reflection on the upper surface 20 occurs when the sunlight has a high inclination.

This is formalized as follows, with reference to FIG. 3. Obviously, this situation occurs when the inclination is $\theta=90°$ and for angles below until some threshold is reached, defined as $\theta_{max}$. Therefore, total reflection on the upper surface (20, 40) happens for $\theta_{max}<\theta<90°$.

Figure 4:
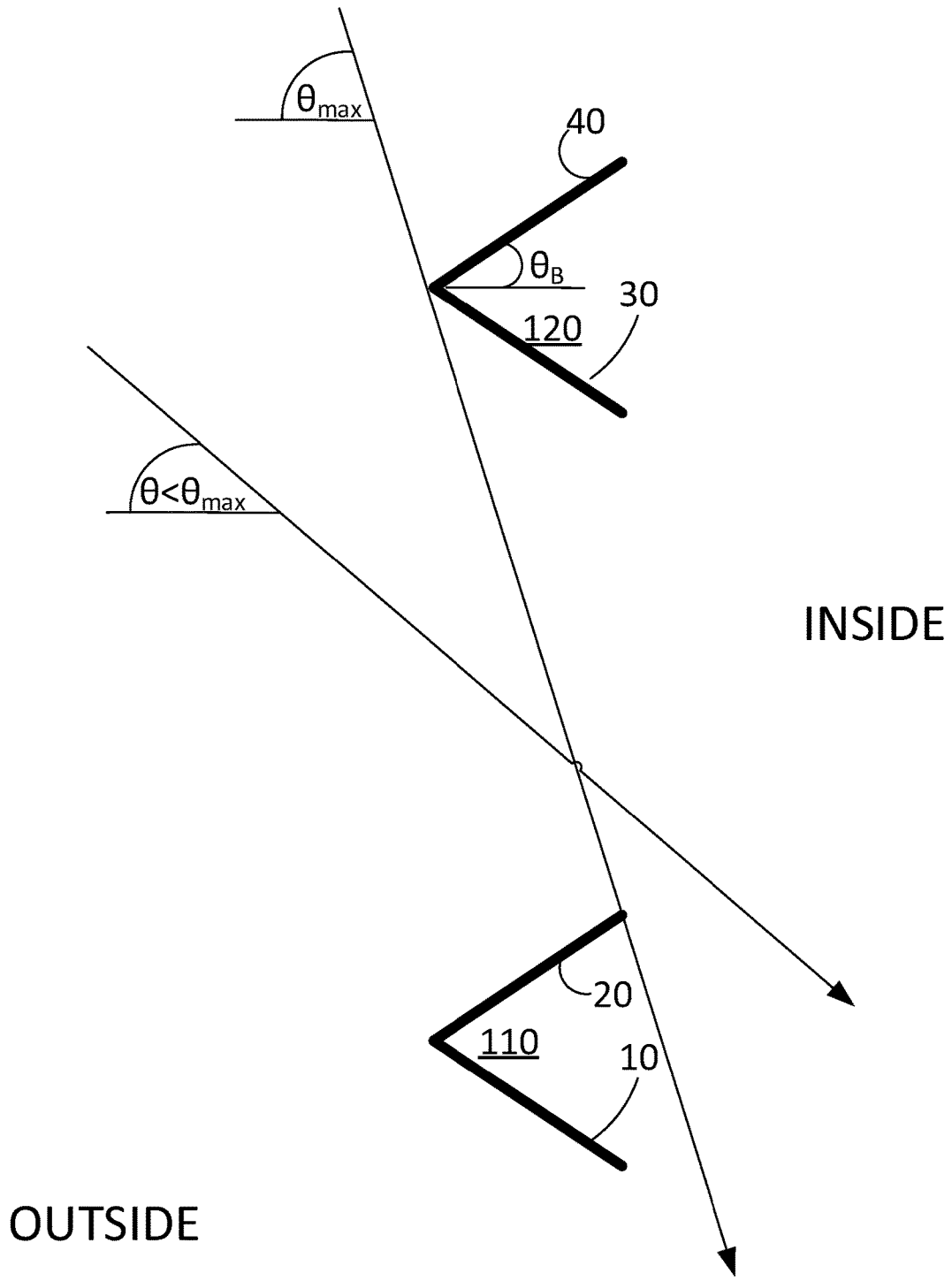
FIG. 4 is a side view of slats in a threshold situation in which the sunlight is mostly reflected outwardly by a single reflection on an upper surface but in which one ray directly penetrates inside (threshold for situation 2), according to an embodiment.

At $\theta=\theta_{max}$, there is one light ray that can pass through the blind 50 directly into the inner environment, as shown in FIG. 4. It can be shown by basic trigonometry that $\theta_{max}=\arctan(H/(D-p))$. Therefore, the angle $\theta_{max}$ is totally dependent upon the designer of the blind 50, which means that the designer can advantageously adjust variables H, D, and/or p to make sure that the value of $\theta_{max}$ is suited for the territory in which this specific design of blinds is to be deployed. For example, the blind 50 may be designed so that $\theta_{max}$ is close to 90° (for example in arctic environments) if a total light reflection is never needed, while it can be designed so that $\theta_{max}$ is low (e.g., 45°) for tropical environments where the sun is often high in the sky and when it is better if most of the sunlight is reflected in the middle of the day. Numeric examples are provided further below.

Situation 1 also occurs for sunlight inclinations $\theta<\theta_{max}$, although in a decreasing proportion. It can be shown that for $0°<\theta<\theta_{max}$, the proportion of sunlight that is reflected at least once on the upper surface (20, 40) is $S\cdot\sin(\theta+\theta_B)/(D\cdot\cos(\theta))$. This proportion visibly decreases strongly as $\theta$ decreases. However, some of the sunlight among this proportion can undergo double (or multiple) reflection and/or be reflected inwardly (toward the inner environment, see situation 3 below). These situations only happen if $\theta<\theta_B$ and are described further below.

Situation 2 is the situation under which a fraction of the incoming sunlight directly penetrates inside by passing through the blind 50 (the empty space of height d). As mentioned above, this situation cannot occur for $\theta>\theta_{max}$. However, it takes place for angles $0°<\theta<\theta_{max}$, as illustrated in FIG. 4. Letting sunlight pass through the blind 50 for low angles is desirable, since the warming of the inner environmental when the inclination of the sun is low is usually not an issue; it is in fact often desirable.

A question may arise knowing that sunlight can pass through the blind 50 for angles slightly under $\theta_{max}$, knowing that $\theta_{max}$ can be quite high (>70°): it should be determined if the blind 50 let too much light pass therethrough for high angles slightly under $\theta_{max}$. Advantageously, the blind 50 is designed in such a way that this is not an issue. More precisely, even though there is light passing through the blinds at such relatively high angles (slightly under $\theta_{max}$), the proportion of the incoming sunlight that is in this situation is a function of $\theta$, and this proportion is low when $\theta$ is slightly under $\theta_{max}$. More precisely, this proportion is constant at low angles and has a value of d/D when $\theta<\theta_B$. For medium angles, i.e., when $\theta_B<\theta<\theta_{max}$, the proportion is what is not reflected (see situation 1 above), so it is worth $1-S\cdot\sin(\theta+\theta_B)/(D\cdot\cos(\theta))$. This proportion is very small for angles slightly under $\theta_{max}$, and becomes significant at lower sunlight inclinations. This is the desired behavior of the blind 50 for its purpose.

Figure 5:
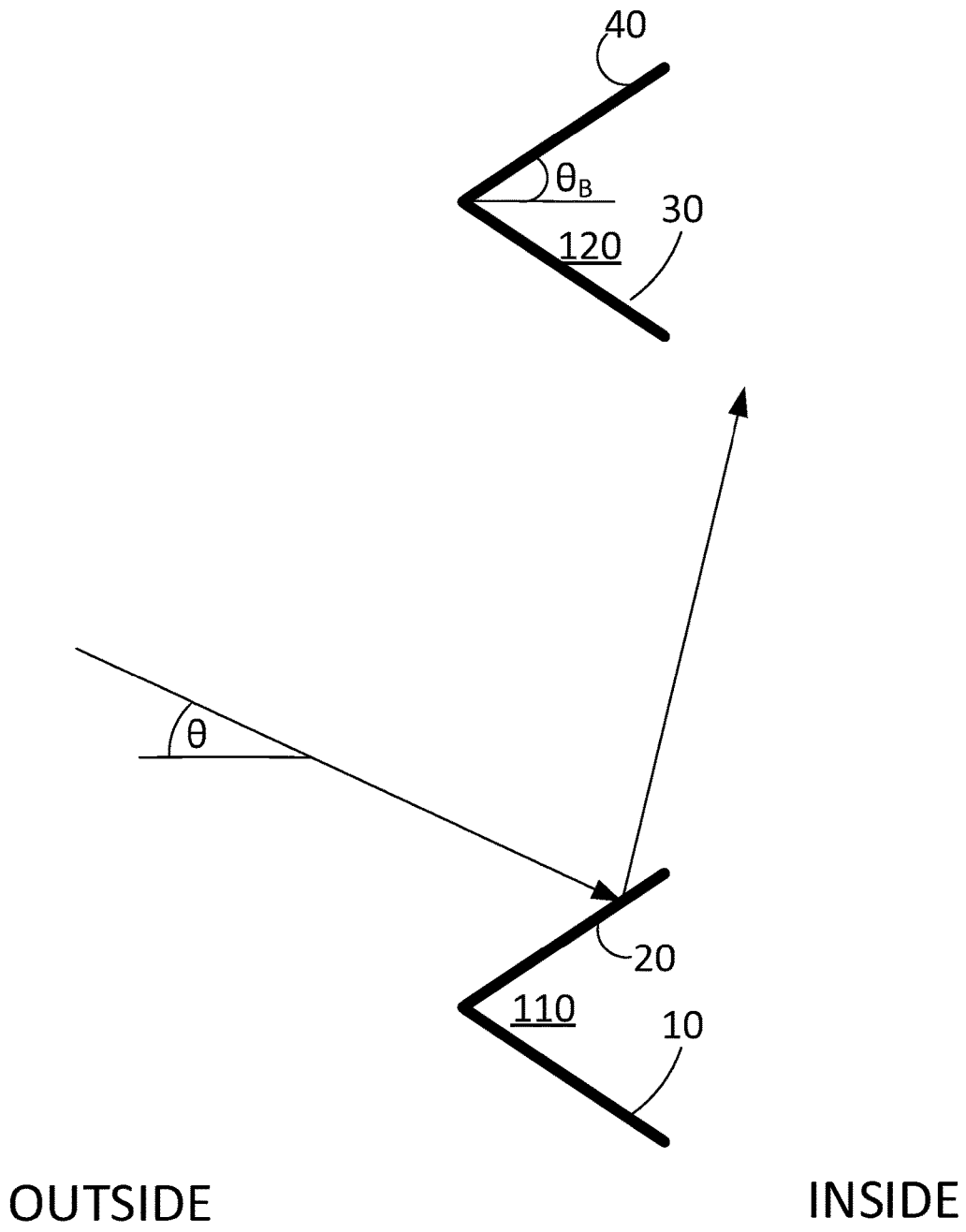
FIG. 5 is a side view of slats in which the sunlight is reflected inwardly by a single reflection on an upper surface of a lower slat (situation 3), according to an embodiment.

As mentioned above, sunlight can be reflected (once) inwardly on the upper surface 20, which is situation 3, exemplified in FIG. 5. This situation is contributory to the heating of the inner environment and should therefore exist at low angles only. The existence of this situation is also enabled by the specular nature of the upper surface 20, which is not found on conventional blinds.

Indeed, it can be shown that situation 3 can advantageously occur for medium angles (if it occurs). By trigonometrical considerations, one can find that this situation occurs if $\arctan((D-p)/H)-2\theta_B<\theta<90°-2\theta_B$. Numeric examples provided further below will show that this situation either does not occur, or occurs at low to medium angles. It never occurs at high angles.

Figure 6:
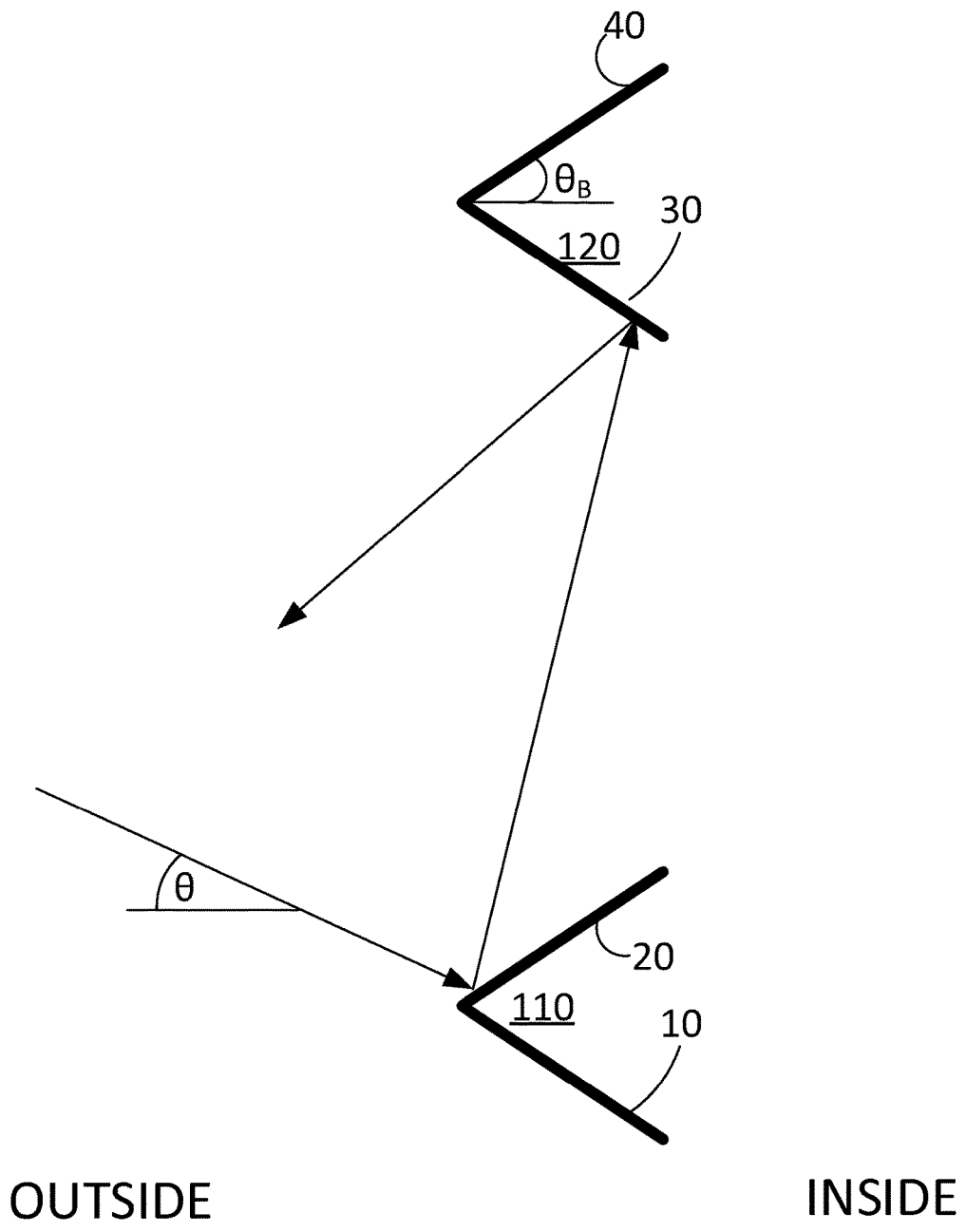
FIG. 6 is a side view of slats in which the sunlight is reflected outwardly by a double reflection, first on an upper surface of a lower slat and then on a lower surface of an upper slat (situation 4), according to an embodiment.

As mentioned above, sunlight can be reflected (twice) outwardly on the upper surface 20 of the lower slat 110 and then on the lower surface 30 of the upper slat 120, which is situation 4, shown in FIG. 6. This situation is contributory to the blocking of incoming sunlight into the inner environment and should therefore not exist at low angles. The existence of this situation is also enabled by the specular nature of both the upper and lower surfaces, which is not found on conventional blinds.

By trigonometrical considerations, one can find that this situation occurs if $90°-2\theta_B<\theta<180°-\theta_{max}-2\theta_B$. Numeric examples provided further below will show that this situation either does not occur, or occurs at low angles, or occurs at medium angles. Therefore, the blind 50 needs to be designed with a particular attention to this range of values to make sure the situation occurs at medium angles at which outward reflection is wanted. By inspection, one can see that the value of $\theta_B$ is critical: if $\theta_B$ is too high (close to 45° or above), double reflection will occur at low sun inclinations and the inner environment will be deprived from desirable sunlight.

Next situations involve a first reflection on the lower surface 30. These situations have a minor importance, since they occur in a very narrow range of circumstances.

Figure 7:
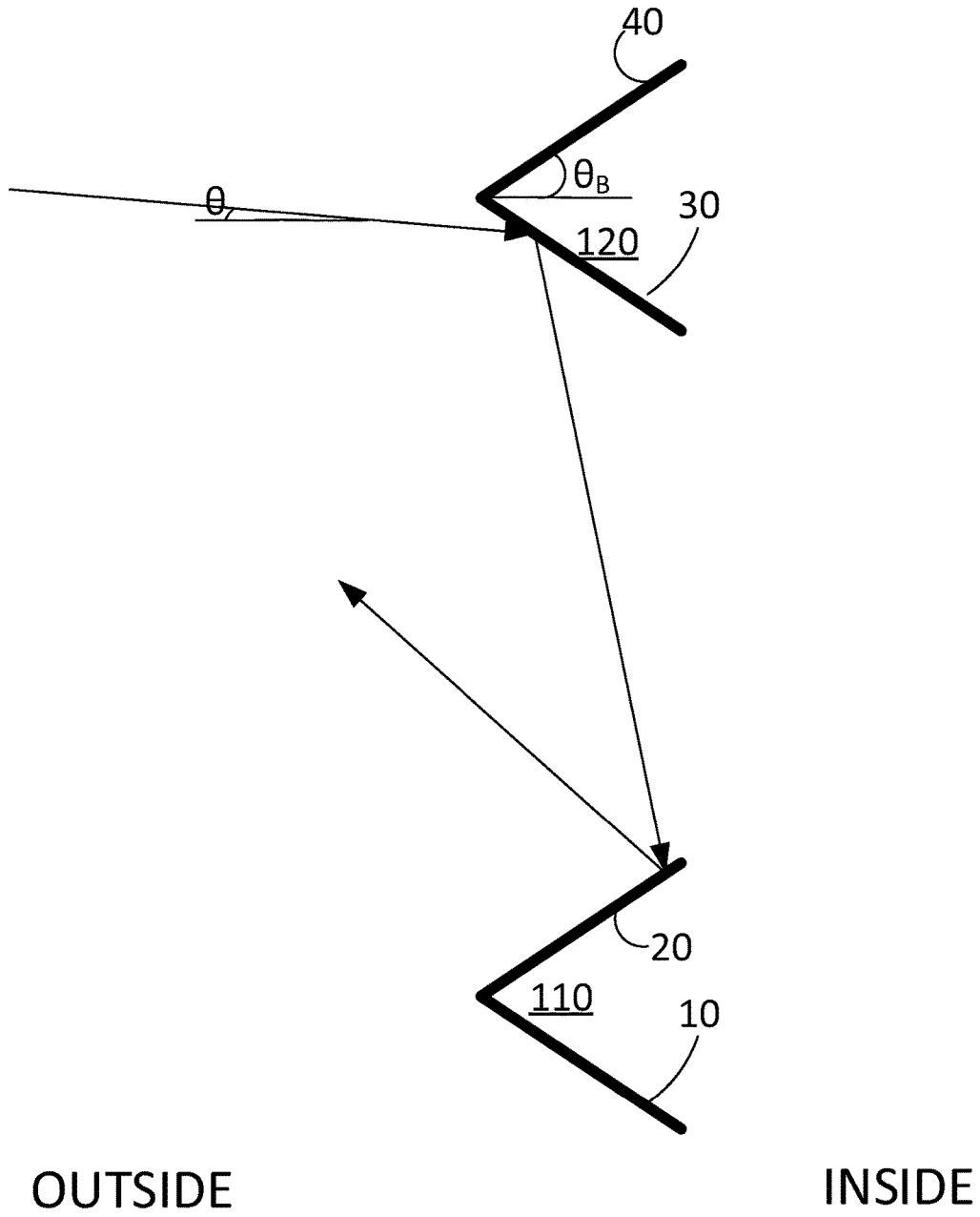
FIG. 7 is a side view of slats in which the sunlight is reflected outwardly by a double reflection, first on a lower surface of an upper slat and then on an upper surface of a lower slat (situation 5), according to an embodiment.

Situation 5, illustrated in FIG. 7, involves double reflection (similar to that mentioned above) in which sunlight first reflects on the lower surface 30 of the upper slat 120 and then on the upper surface 20 of the lower slat 110. This situation occurs for $2\theta_B-\arctan((D-p)/H)<\theta<2\theta_B+\arctan((D-p)/H)-180°$. Often, the minimum threshold is sub-zero and the maximum threshold is a low angle close to zero. This range needs to be kept is small as possible (or under zero) since outward reflection is usually unwanted at low inclinations. This situation (if it occurs) reaches a peak at $\theta=2\theta_B-90°$ (the peak is therefore usually under zero).

Figure 8:
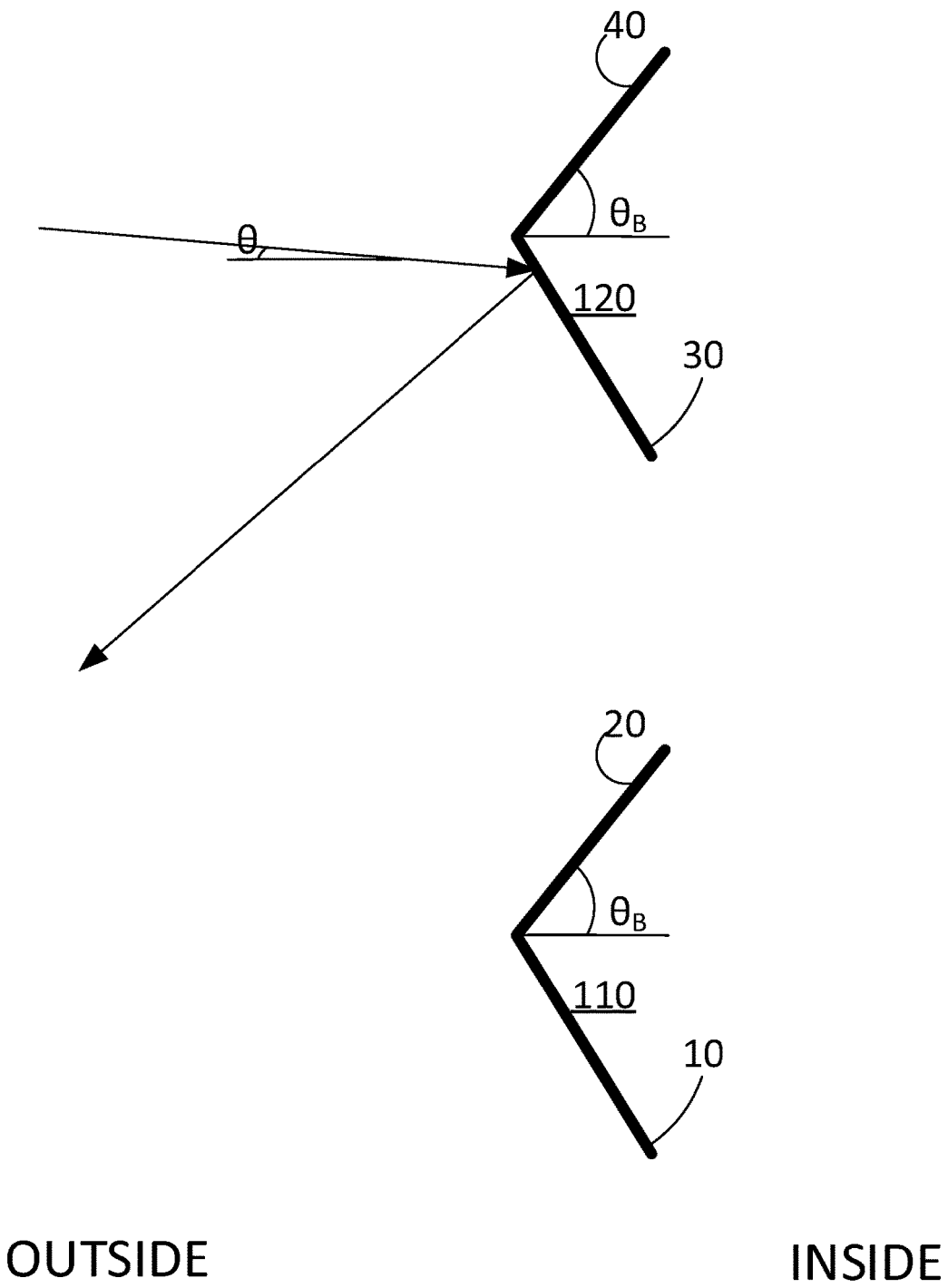
FIG. 8 is a side view of slats in a situation in which the sunlight is reflected outwardly by a single reflection on a lower surface (situation 6), according to an embodiment.

Situation 6, illustrated in FIG. 8, involves a single outward reflection on the lower surface 30 of the upper slat 120. This situation occurs for $2\theta_B-90°<\theta<2\theta_B+\arctan((D-p)/H)-180°$. Usually, both the maximum and minimum thresholds are sub-zero, which means that the situation does not occur. In fact, it does not occur if $\theta_B<45°$, which is usually the case, as mentioned above.

Figure 9:
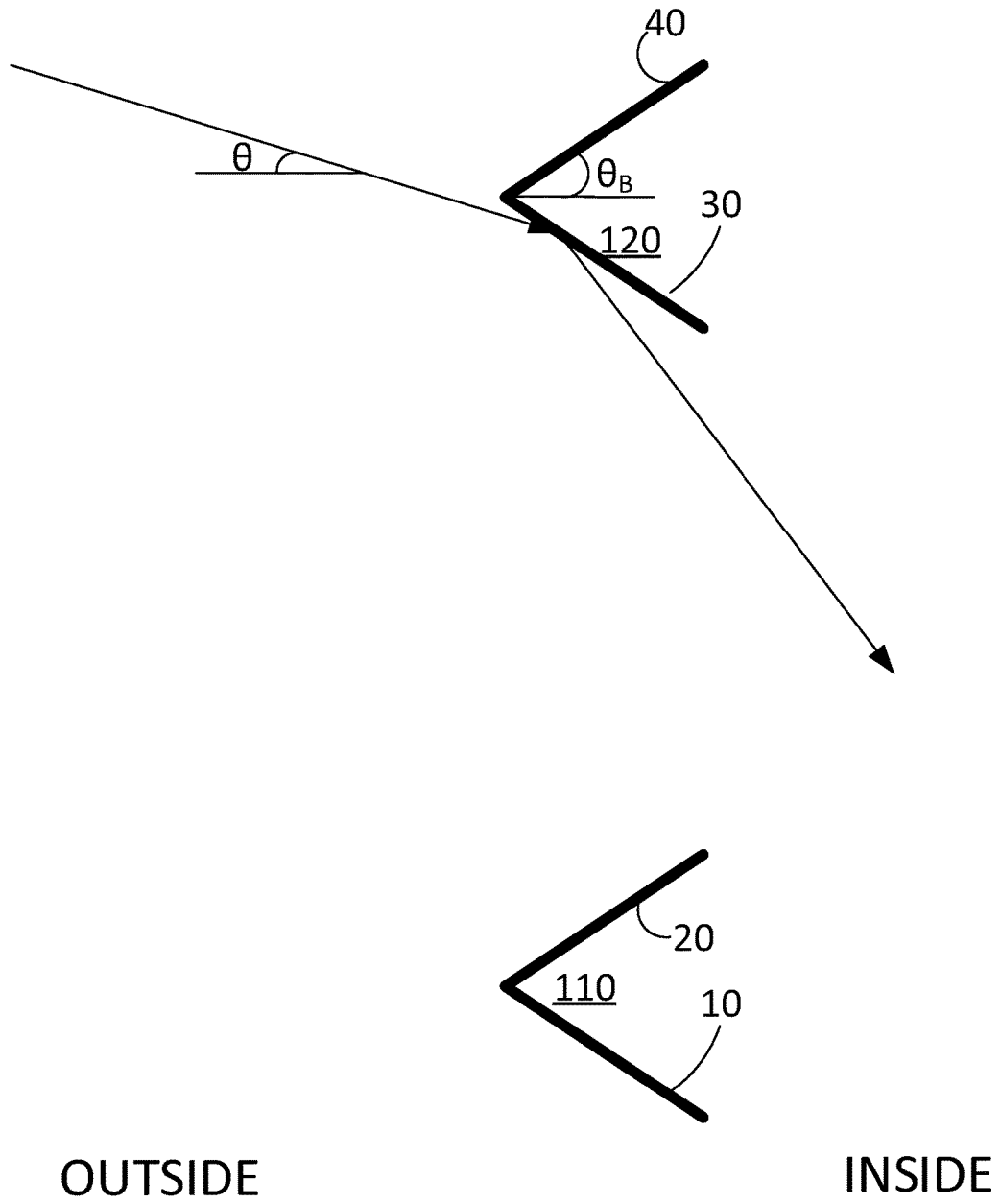
FIG. 9 is a side view of slats in a situation in which the sunlight is reflected inwardly by a single reflection on a lower surface (situation 7), according to an embodiment.

Situation 7, illustrated in FIG. 9, involves a single reflection on the lower surface 30 of the upper slat 120, resulting in an inward reflection which contributes to heating the inner environment. It can be seen easily that this situation cannot occur for $\theta>\theta_B$. This situation is significant (increases with decreasing $\theta$) for $2\theta_B-\arctan((D-p)/H)<\theta<\theta_B$. For $2\theta_B-90°<\theta<2\theta_B-\arctan((D-p)/H)$, the situation is less significant (decreases with decreasing $\theta$).

From situation 5 to 7, situation 7 is generally the dominant one. This is fortunate, since penetration of light inside the building at low inclinations is generally wanted. This situation is enabled by the existence of the lower surface 30 and its specular nature.

Multiple reflections have not been studied, but they occur as a subset of double-reflection situations.

The following table shows numeric examples of some threshold values depending on the design of the blind 50 and summarizes the effect to which the situation contributes. A negative value can be interpreted as zero. A value above 90° can be interpreted as 90°. Some situations may not occur because other situations take over, for example if a threshold is above $\theta_{max}$. Angles are in degrees and distances in meters.

TABLE 1

Numeric examples of angular thresholds for all 7 situations

| | | | | | situation 1 (Non-Heating) | | | situation 2 (Heating) | | |
|---|---|---|---|---|---|---|---|---|---|---|
| H | D | p | d | $\theta_B$ | min | middle ($\theta_{max}$) | max | min | middle | max |
| 0.1 | 0.5 | 0.05 | 0.4 | 26.6 | 0.0 | 77.5 | 90.0 | 0.0 | 26.6 | 77.5 |
| 0.2 | 1 | 0.08 | 0.84 | 21.8 | 0.0 | 77.7 | 90.0 | 0.0 | 21.8 | 77.7 |
| 0.1 | 1 | 0.05 | 0.9 | 26.6 | 0.0 | 84.0 | 90.0 | 0.0 | 26.6 | 84.0 |
| 0.3 | 1.5 | 0.2 | 1.1 | 33.7 | 0.0 | 77.0 | 90.0 | 0.0 | 33.7 | 77.0 |
| 0.12 | 1.2 | 0.12 | 0.96 | 45.0 | 0.0 | 83.7 | 90.0 | 0.0 | 45.0 | 83.7 |
| 0.3 | 2 | 0.075 | 1.85 | 14.0 | 0.0 | 81.1 | 90.0 | 0.0 | 14.0 | 81.1 |
| 0.01 | 1.4 | 0.5 | 0.4 | 88.9 | 0.0 | 89.4 | 90.0 | 0.0 | 88.9 | 89.4 |
| 0.15 | 0.5 | 0.3 | −0.1 | 63.4 | 0.0 | 53.1 | 90.0 | 0.0 | 63.4 | 53.1 |
| 0.5 | 0.5 | 0.15 | 0.2 | 16.7 | 0.0 | 35.0 | 90.0 | 0.0 | 16.7 | 35.0 |

| | | | | | situation 3 (Heating) | | situation 4 (Non-Heating) | | Situation 5 (Non-Heating) | | situation 6 (Non-Heating) | | situation 7 (Heating) | | |
|---|---|---|---|---|---|---|---|---|---|---|---|---|---|---|---|
| H | D | p | d | $\theta_B$ | min | max | min | max | min | max | min | max | min | middle | max |
| 0.1 | 0.5 | 0.05 | 0.4 | 26.6 | 24.3 | 36.9 | 36.9 | 49.4 | −24.3 | −49.4 | −36.9 | −49.4 | −36.9 | −24.3 | 26.6 |
| 0.2 | 1 | 0.08 | 0.84 | 21.8 | 34.1 | 46.4 | 46.4 | 58.7 | −34.1 | −58.7 | −46.4 | −58.7 | −46.4 | −34.1 | 21.8 |
| 0.1 | 1 | 0.05 | 0.9 | 26.6 | 30.9 | 36.9 | 36.9 | 42.9 | −30.9 | −42.9 | −36.9 | −42.9 | −36.9 | −30.9 | 26.6 |
| 0.3 | 1.5 | 0.2 | 1.1 | 33.7 | 9.6 | 22.6 | 22.6 | 35.6 | −9.6 | −35.6 | −22.6 | −35.6 | −22.6 | −9.6 | 33.7 |
| 0.12 | 1.2 | 0.12 | 0.96 | 45.0 | −6.3 | 0.0 | 0.0 | 6.3 | 6.3 | −6.3 | 0.0 | −6.3 | 0.0 | 6.3 | 45.0 |
| 0.3 | 2 | 0.075 | 1.85 | 14.0 | 53.1 | 61.9 | 61.9 | 70.8 | −53.1 | −70.8 | −61.9 | −70.8 | −61.9 | −53.1 | 14.0 |
| 0.01 | 1.4 | 0.5 | 0.4 | 88.9 | −88.3 | −87.7 | −87.7 | −87.1 | 88.3 | 87.1 | 87.7 | 87.1 | 87.7 | 88.3 | 88.9 |
| 0.15 | 0.5 | 0.3 | −0.1 | 63.4 | −73.7 | −36.9 | −36.9 | 0.0 | 73.7 | 0.0 | 36.9 | 0.0 | 36.9 | 73.7 | 63.4 |
| 0.5 | 0.5 | 0.15 | 0.2 | 16.7 | 1.6 | 56.6 | 56.6 | 111.6 | −1.6 | −111.6 | −56.6 | −111.6 | −56.6 | −1.6 | 16.7 |

Having a large value for H helps favoring heating situations at low inclinations and non-heating situations at high inclinations, while leaving a large value for d which lets the inhabitants have a view to the outside world.

It can thus be seen that situations which contribute to reflecting the sunlight outwardly at high sunlight inclinations and situations which contribute to reflecting inwardly or letting sunlight in the building at low sunlight inclinations are favored by the design of the blind 50 described above, thereby providing an inclination-dependent sunlight selection that naturally, and without any user assistance, contributes to the temperature control in a building (or any other inner environment).

Furthermore, the design is simple since it involves reflecting slats installed on commonly found lifting cords for conventional blinds. It can thus be produced at low cost and thus not involve adapting the windows to the blinds.

Advantageously, the system can be modeled to optimize light reflection for high inclinations and light passing-though for low inclinations, but as well, it can be optimized to have the blind 50 work with the largest value for distance d. By optimizing the system with the largest value for d, the people who live in the inner environment can enjoy a less encumbered and clearer view of the outside world, with a minimal impact of the blind 50 on the field of view. This can be performed by preferring a high value of H compared to p when designing the blind 50, which is advantageous on the blind overall performance, as seen in the table.

The embodiment illustrated in FIGS. 1-9 had the upper surface 20, 40 and the lower surface 10, 30 with the same angle value ($+\theta_B$ for the upper surface 20, 40 and $-\theta_B$ for the lower surface 10, 30). Although not discussed, in other embodiments, the upper surface 20, 40 can be made to have an angle with the horizon ($\theta_B$) different (in absolute value) from the lower surface 10, 30.

According to an embodiment, the lower surface 10, 30, which would normally be expected to extend downwardly from the horizon (negative angle with respect to the horizon), can instead have a positive angle and therefore extend upwardly. The extreme case of this embodiment is the case where the lower surface 10, 30 is coincident with the upper surface 20, 40 of the slat 110, 120. In this specific case that is discussed in more detail below, the slats 110, 120 are considered as single slats (the upper surface 20, 40 does not form any angle with the lower surface 10, 30; both are extending with an angle $+\theta_B$). Both surfaces (20, 40 and 10, 30) are thus integrally connected substantially along their whole surface. The single flat slats 110, 120 thus comprise a base that is easier to manufacture. A flat slat needs to be produced and coated on both upper and lower surfaces with a reflective material.

Figure 10:
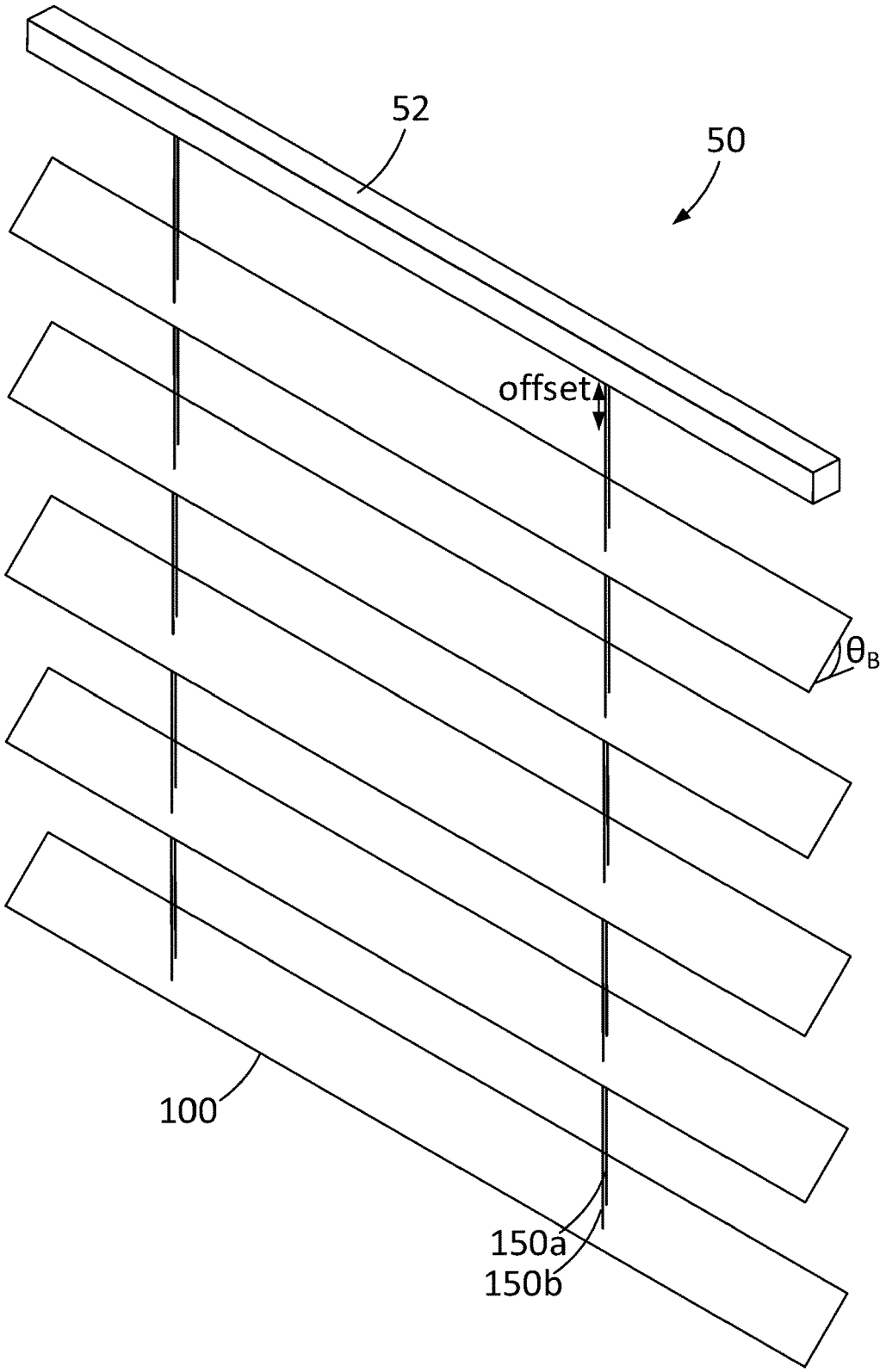
FIG. 10 is a perspective view of a sunlight-reflecting blind, according to another embodiment.

Now referring to FIGS. 10-14, there is shown this other embodiment of the blind 50. Indeed, even though the embodiment described above in reference to FIGS. 1-9 can be produced at low cost, additional cost reductions can be contemplated by further refining the design to include more single flat slats instead of triangular slats, as shown in FIG. 10.

The additional cost of having a triangular slat instead of a flat slat should be compared with the additional energy savings attributed to the presence of a lower surface (10, 30).

Indeed, some reflective modes described above are useful in reducing the undesirable heating of the inside, but these reflective modes do not exist anymore in this embodiment. More specifically, the reflective modes of FIGS. 6, 7 and 8 do not exist in this case where the lower surface 10, 30 is brought directly under the upper surface 20, 40. These modes have been identified as advantageous at low sun inclinations. However, their contribution to the overall reflection is not as significant as the mode of reflection illustrated in FIG. 3, for example. The cost of relinquishing these reflecting modes (in terms of energetic performance) should be compared with the cost of providing a lower surface 10, 30 as in the embodiment of FIGS. 1-9. One might determine that the additional manufacture cost to have a lower surface 10, 30 as in the embodiment of FIGS. 1-9 is 75% of the overall cost while it is only responsible of 10% of the energy savings (this is a fictional example). This determination will depend on the climate of a specific place, the priority of the building operator (energy savings or dollar savings), the cost of manufacture, etc.

Figure 11:
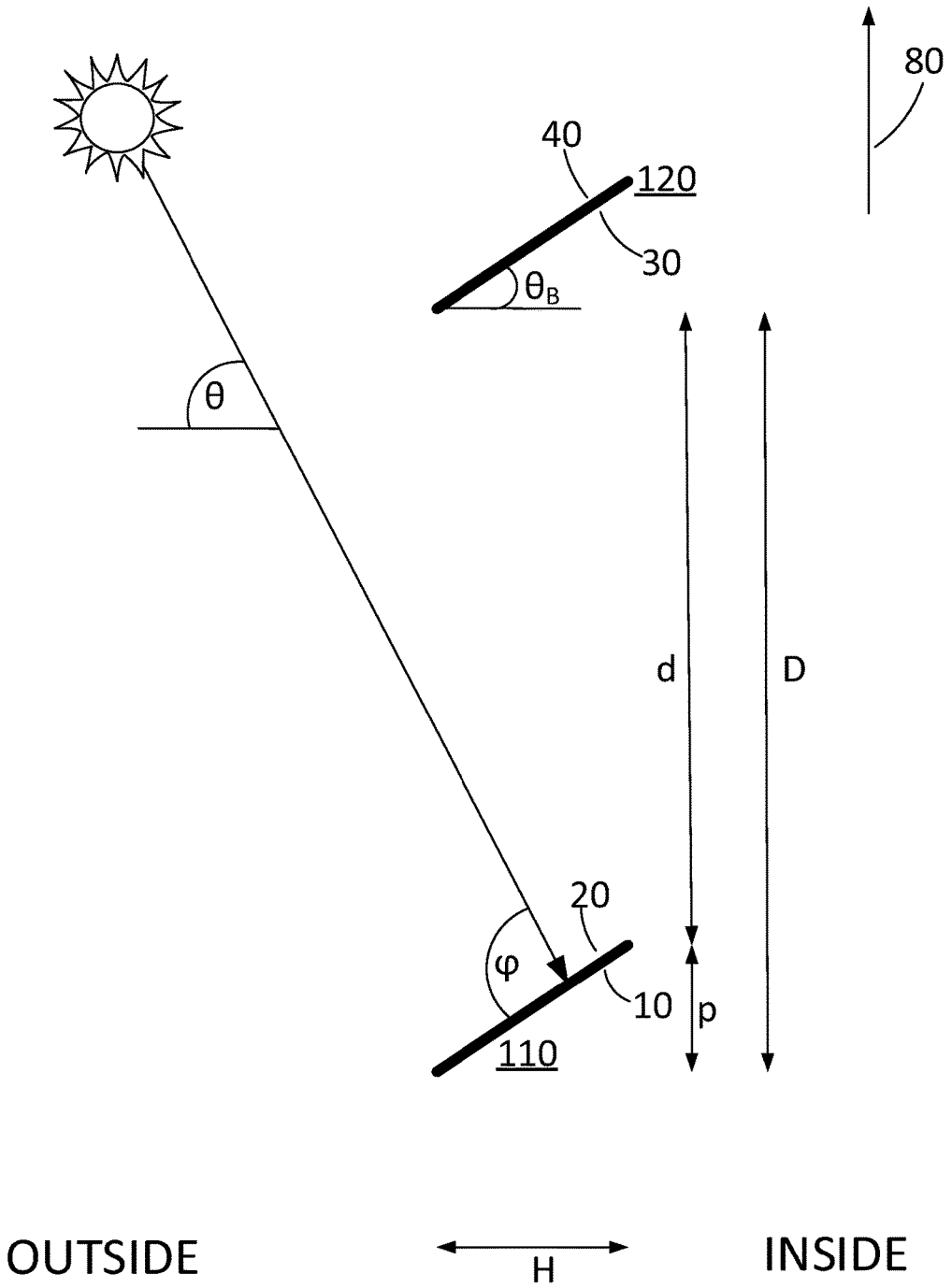
FIG. 11 is a side view illustrating a pair of single slats, including various angles used to describe the system, according to another embodiment.

FIG. 11 shows the configuration of the slats 110, 120 of such an embodiment.

Figure 3:
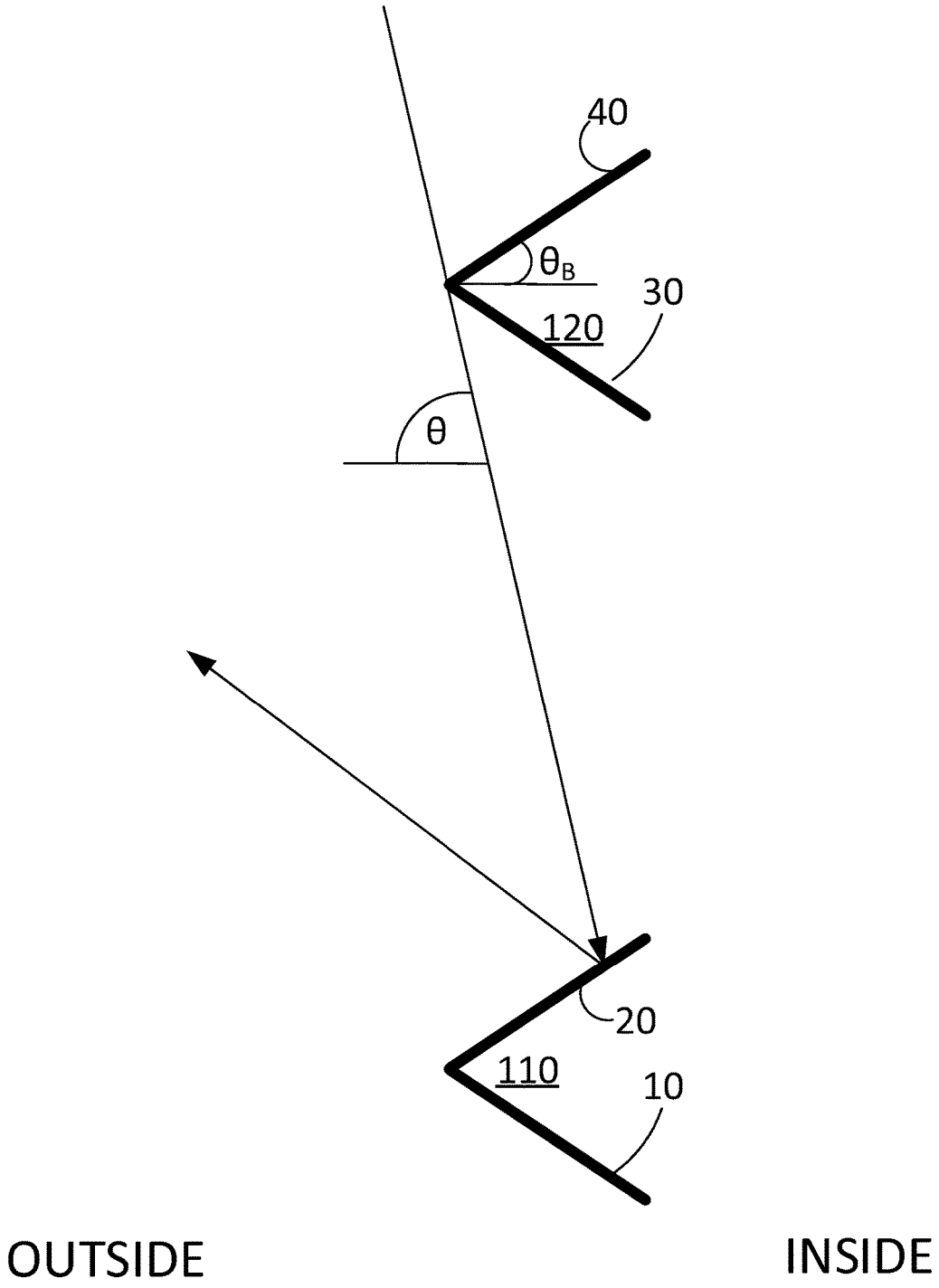
FIG. 3 is a side view of slats in a situation in which the sunlight is totally reflected outwardly by a single reflection on an upper surface (situation 1), according to an embodiment.
Figure 12:
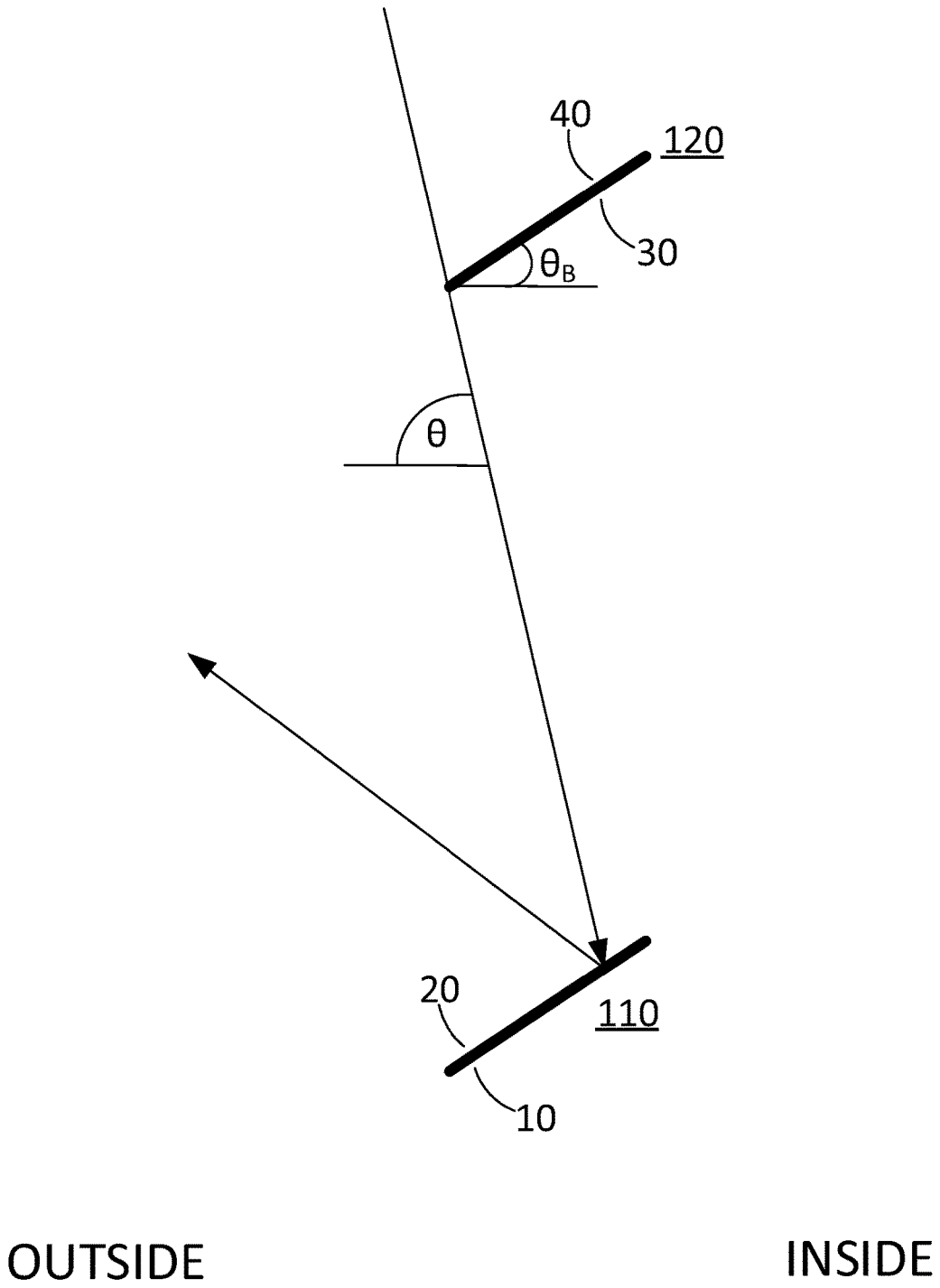
FIG. 12 is a side view of slats in a situation in which the sunlight is totally reflected outwardly by a single reflection on an upper surface (situation 1), according to another embodiment.

FIG. 12 shows the equivalent of the reflective mode shown in FIG. 3. This mode is unchanged.

Figure 13:
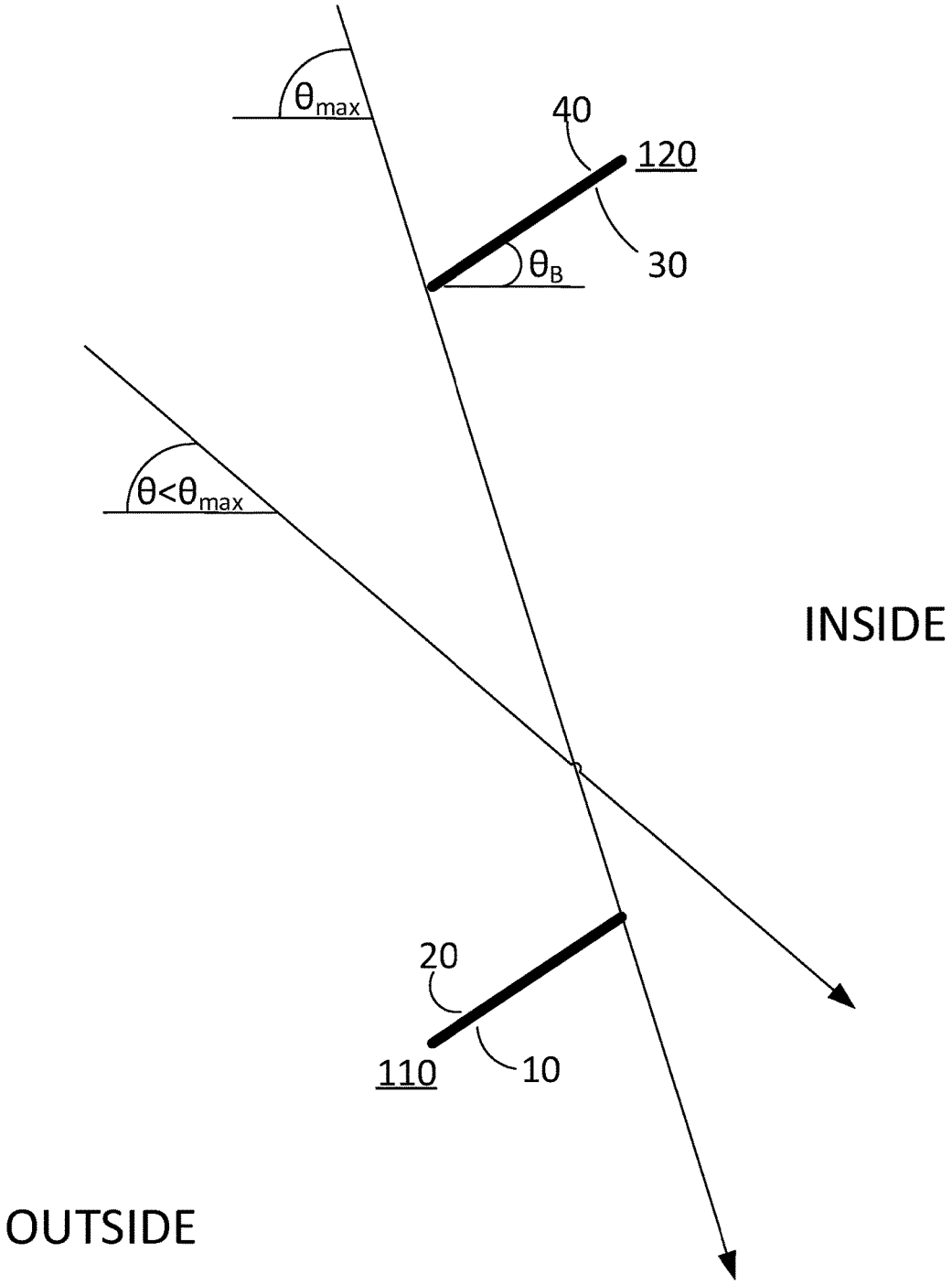
FIG. 13 is a side view of slats in a threshold situation in which the sunlight is mostly reflected outwardly by a single reflection on an upper surface but in which one ray directly penetrates inside (threshold for situation 2), according to another embodiment.

FIG. 13 shows the equivalent of the reflective mode shown in FIG. 4. This mode occurs on a greater range of angles, i.e., for lower values of θ, since the lower surfaces 10, 30 are brought up to be coincident with the upper surfaces 20, 40. In other words, the mode of FIG. 13 covers the ranges of angles θ of both FIGS. 4, 7, 8 and 9. The advantageous reflection modes of FIGS. 7-8 do not exist with the "single-slat" embodiment.

Figure 14:
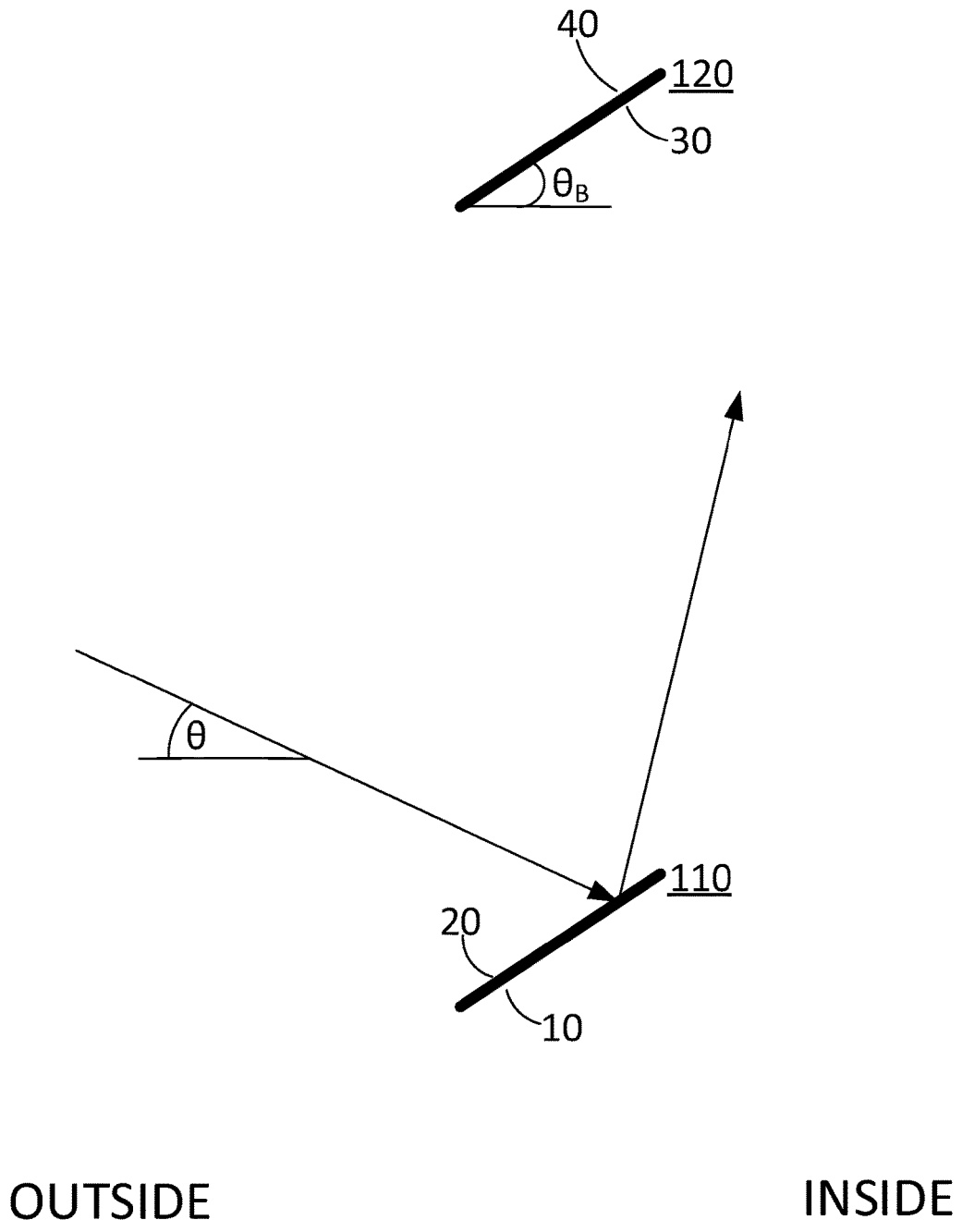
FIG. 14 is a side view of slats in which the sunlight is reflected inwardly by a single reflection on an upper surface of a lower slat (situation 3), according to another embodiment.

FIG. 14 shows the equivalent of the reflective mode shown in FIG. 5. This mode occurs on a greater range of angles, i.e., for lower values of θ, since the lower surfaces 10, 30 are brought up to be coincident with the upper surfaces 20, 40 and cannot reflect back to the outside the first reflection, as shown in FIG. 6. In other words, the mode of FIG. 14 covers the ranges of angles θ of both FIGS. 5 and 6.

According to an embodiment, the slats 100 are held by strings 150 that are located toward the left end and the right end of the slat, as shown in FIG. 2. According to another embodiment shown in FIG. 10, there is a plurality (usually two) of strings 150*a*, 150*b* toward the left and right sides of the slats 100.

In every case, care should be given to ensure that the slats 100 keep the same angle $\theta_B$ in all circumstances. In the embodiment with two pairs of strings 150*a*, 150*b*, this can be done by providing an offset at the upper portion of the strings 150*b* compared to the strings 150*a*, i.e., the string 150*b* is longer at the top before reaching (downwardly from the top) the uppermost slat 100.

Figure 15:
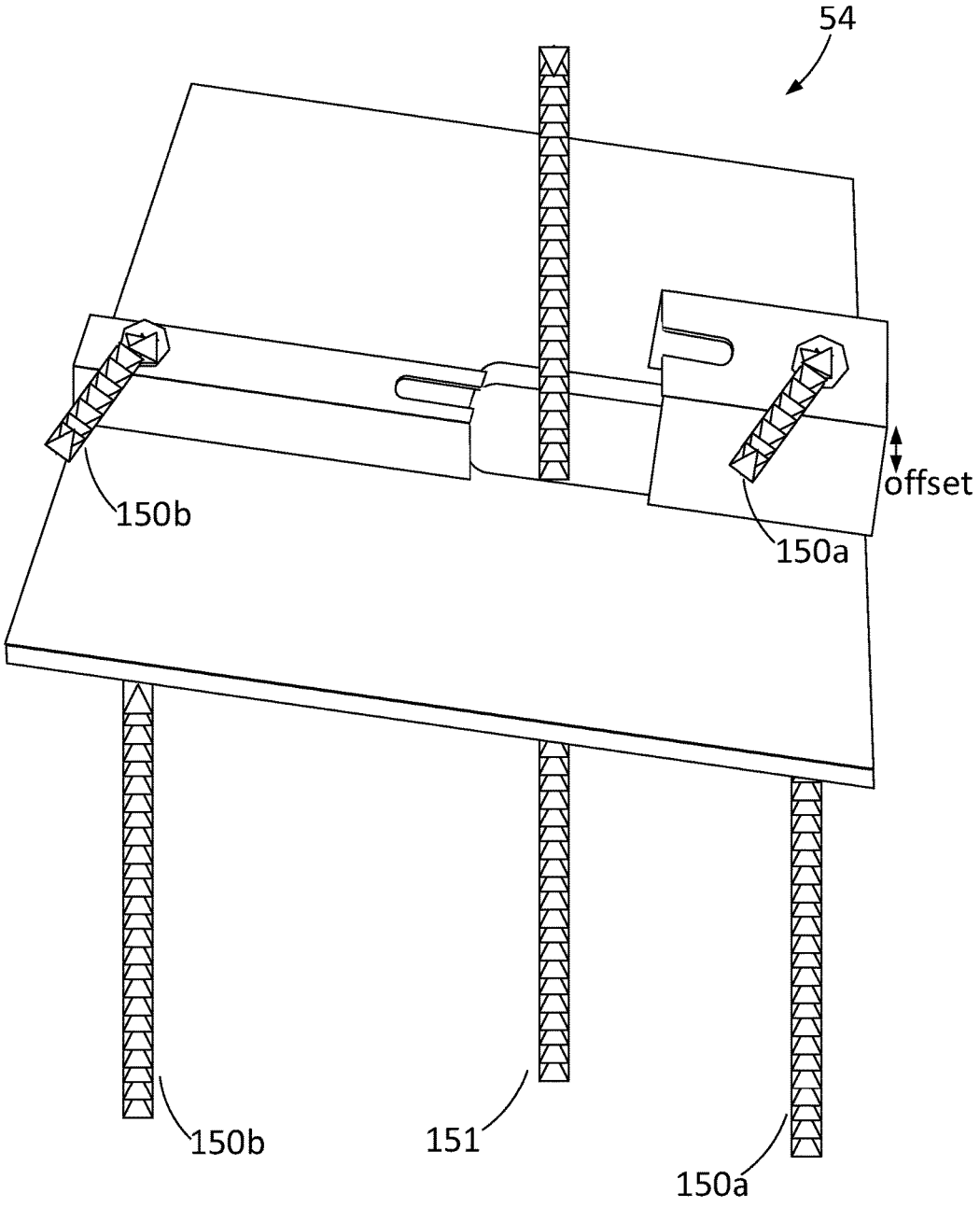
FIG. 15 is a perspective view of an angle holding cradle inside a headrail, according to another embodiment.

A headrail 52 can be provided to hold the strings 150. An angle holding cradle 54, shown in FIG. 15, can be installed inside the headrail to hold the strings 150 and create the offset that controls the angle $\theta_B$ of the slats which, once determined (e.g., for an optimal reflection at a given latitude), is not supposed to change. As illustrated in FIG. 15, the angle holding cradle 54 comprises a body for mounting surfaces which are at different heights inside the headrail 52 on which the strings 150*a*, 150*b* are attached (a knot is shown on these surfaces to hold the strings 150*a*, 150*b*). The difference in heights is the offset, which remains constant. The headrail 52 can be sold with the angle holding cradle 54 having surfaces with heights adapted for a given geographic zone (depending on the latitude) to keep an angle optimized for this geographic zone. A lifting mechanism, not shown, can be incorporated to the headrail 52 and extend therefrom to be manipulated by a user to lift the blinds. This lifting mechanism can communicate with a string 151, shown in FIG. 15, which is attached to the bottommost slat 100 to lift the slats upwardly.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A blind for installation between an inner environment and an outer environment where light originates, the blind comprising:

slats substantially forming a vertically periodic arrangement, each one of the slats extending in a substantially horizontal axis and comprising:

an upper surface having a normal oriented both upwardly and toward the outer environment, the upper surface having a coating that provides specular reflection, and a lower surface having a normal oriented both downwardly and toward the outer environment, the lower surface having a coating that provides specular reflection, the upper surface having a lower edge and the lower surface having an upper edge, wherein the upper surface and the lower surface of a given slat are joined at an apex where the lower edge of the upper surface and the upper edge of the lower surface are joined, the upper surface and the lower surface of a slat defining a space there between that is empty, such that the upper surface and the lower surface are held together only by the apex;

tilt strings and an angle holding cradle that maintains a non-zero constant height offset between the tilt strings, wherein the angle holding cradle k installed inside a headrail of the blind thereby:

maintaining a constant angle of the upper surface of all slats even though at least some of the slats are lifted; and maintaining a constant distance between slats to provide a constant view of the outer environment from the inner environment, and lift strings extending through the slats, wherein the headrail further comprises a lifting mechanism for pulling the lift strings and thereby lifting at least some of the slats while maintaining the constant angle.

2. The blind of claim 1, wherein the lift strings are to hold the slats in the vertically periodic arrangement.

3. The blind of claim 2, wherein the angle holding cradle comprises a surface holding one of the tilt strings at a constant height offset with another one of the tilt strings.

4. The blind of claim 1, wherein the light has an inclination with respect to the horizontal, further wherein:

when inclination of the light is above a high inclination threshold, the light is substantially totally outwardly reflected by the upper surface of the slats;

when inclination of the light is below a low inclination threshold, the light partially penetrates directly in the inner environment and the remaining portion of the light is reflected outwardly by both the upper and lower surfaces; and when inclination of the light is between the high inclination threshold and the low inclination threshold, the light partially penetrates directly into the inner environment, and is partially outwardly reflected by a double reflection on both the upper surface and the lower surface.

5. A blind for installation between an inner environment and an outer environment where light originates, the blind comprising:

slats substantially forming a vertically periodic arrangement, each one of the slats extending in a substantially horizontal axis and comprising:

an upper surface having a normal oriented both upwardly and toward the outer environment, the upper surface having a coating that provides specular reflection, and a lower surface having a normal oriented both downwardly and toward the inner environment, the lower surface having a coating that provides specular reflection, tilt strings and an angle holding cradle, provided inside a headrail of the blind and comprising a surface holding one of the tilt strings at a non-zero constant height offset with another one of the tilt strings, that maintains the constant height offset between the tilt strings, thereby:

maintaining a constant angle of the upper surface of all slats even though at least some of the slats are lifted; and maintaining a constant distance between slats to provide a constant view of the outer environment from the inner environment, and lift strings extending through the slats, wherein the headrail further comprises a lifting mechanism for pulling the lift strings and thereby lifting at least some of the slats while maintaining the constant angle.

6. The blind of claim 5, wherein the lower surface and the upper surface have normals oriented in substantially opposite directions.

7. The blind of claim 6, wherein the upper surface and the lower surface are integrally connected along their whole surface.

8. The blind of claim 7, wherein the constant angle maintained by the angle holding cradle, together with a period of the periodic arrangement, defines high and low inclination thresholds, wherein the light has an inclination with respect to the horizontal and, further wherein the constant angle is set such that:

when inclination of the light is above the high inclination threshold, the light is substantially totally outwardly reflected by the upper surface of the slats;

when inclination of the light is below the low inclination threshold, the light partially penetrates directly in the inner environment and the remaining portion of the light is reflected outwardly by the upper surface; and when inclination of the light is between the high inclination threshold and the low inclination threshold, the light partially penetrates directly into the inner environment, and is partially inwardly reflected by a double reflection on both the upper surface and the lower surface.

9. A blind for installation close to an interface between an inner environment and an outer environment where light originates, the light having an inclination with respect to the horizontal, the blind comprising:

slats forming a vertically periodic arrangement, each one of the slats extending in a substantially horizontal axis and comprising an upper surface and a lower surface, joined together at an apex where a lower edge of the upper surface and an upper edge of the lower surface are joined, the upper surface and the lower surface of a slat defining a space there between that is empty, such that the upper surface and the lower surface being held together only by the apex, tilt strings and an angle holding cradle that maintains that maintains a non-zero constant height offset between the tilt strings, wherein the angle holding cradle is installed inside a headrail of the blind, thereby:

maintaining a constant angle of the upper surface of all slats even though at least some of the slats are lifted; and maintaining a constant distance between slats to provide a constant view of the outer environment from the inner environment, wherein the constant angle, together with a period of the periodic arrangement, defines high and low inclination thresholds, and lift strings extending through the slats, wherein the headrail further comprises a lifting mechanism for pulling the lift strings and thereby lifting at least some of the slats while maintaining the constant angle, wherein the constant angle is set such that:

when inclination of the light is above the high inclination threshold, the light is substantially totally outwardly reflected by the upper surface of the slats;

when inclination of the light is below the low inclination threshold, the light partially penetrates directly in the inner environment and the remaining portion of the light is inwardly reflected by at least a first one of: the upper surface and the lower surface; and when inclination of the light is between the high inclination threshold and the low inclination threshold, the light partially penetrates directly into the inner environment, and is partially reflected by a double reflection on both the upper surface and the lower surface.

10. The blind of claim 9, wherein the upper surface has a coating providing specular reflection.

11. The blind of claim 10, wherein the lower surface has a coating providing specular reflection.

12. The blind of claim 11, wherein the coating of the upper surface is oriented both upwardly and toward the outer environment.

13. The blind of claim 12, wherein the lower surface has a normal oriented both downwardly and toward the outer environment.

14. The blind of claim 13, wherein when inclination of the light is below a low inclination threshold, the light is reflected outwardly by both the upper and lower surfaces; and when inclination of the light is between the high inclination threshold and the low inclination threshold, the light is partially outwardly reflected by a double reflection on both the upper surface and the lower surface.

15. The blind of claim 12, wherein the coating of the lower surface is oriented both downwardly and toward the inner environment.

16. The blind of claim 15, wherein the lower surface and the upper surface have normals oriented in substantially opposite directions.

17. The blind of claim 16, wherein the upper surface and the lower surface are integrally connected along their whole surface.

18. The blind of claim 17, wherein when inclination of the light is below a low inclination threshold, the light is reflected outwardly by the upper surface only; and when inclination of the light is between the high inclination threshold and the low inclination threshold, the light is partially inwardly reflected by a double reflection on both the upper surface and the lower surface.

* * * * *